United States Patent [19]

Beardslee

[11] 4,261,259

[45] Apr. 14, 1981

[54] BEVERAGE CONTAINER CRUSHER

[76] Inventor: Ricky D. Beardslee, P.O. Box 7243, Odessa, Tex. 79760

[21] Appl. No.: 113,915

[22] Filed: Jan. 21, 1980

[51] Int. Cl.[3] ..... B30B 5/04

[52] U.S. Cl. ..... 100/152; 100/DIG. 2; 100/210; 241/99; 241/200

[58] Field of Search ..... 100/DIG. 2, 151, 152, 100/153, 154, 156, 144; 241/99, 200

[56] References Cited

U.S. PATENT DOCUMENTS

| | | | |
|---|---|---|---|
| 969,720 | 9/1910 | Pickett | 100/DIG. 2 |
| 1,140,676 | 5/1915 | Gray | 100/DIG. 2 |
| 2,844,184 | 7/1958 | Vollmer | 100/DIG. 2 |
| 3,077,827 | 2/1963 | Bunke | 100/DIG. 2 |
| 3,151,814 | 10/1964 | Morgan | 241/99 |
| 3,691,942 | 9/1972 | Wagley | 100/151 |
| 4,195,562 | 4/1980 | Mickler | 100/DIG. 2 |

*Primary Examiner*—Billy J. Wilhite
*Attorney, Agent, or Firm*—Marcus L. Bates

[57] ABSTRACT

A beverage container crusher which flattens beverage containers to reduce the volume thereof so that the resultant crushed containers require very little storage room. The crushing apparatus includes spaced shafts arranged parallel to one another, and an endless belt is supported by the shaft in such a manner that the belt describes an oval track. A fixed plate is arranged at an acute angle with respect to the oval track. A lower portion of the plate continues about one end of the track so that when a beverage container is dropped into the space between the plate and the track, the container gravitates into a position where it is engaged by the traveling belt, so that the belt forces the container through the narrow space formed between the curved part of the plate and one curved end of the oval track. The flattened container drops into a storage container located below the container crusher apparatus where the containers may be accumulated and subsequently recycled.

10 Claims, 5 Drawing Figures

BEVERAGE CONTAINER CRUSHER

BACKGROUND OF THE INVENTION

The patrons of night clubs, bars, sporting events, and other similar entertainment places consume a vast quantity of beverages. The beverages, such as soft drinks and beer, usually are purchased in metal containers. The empty containers accumulate in an astonishing number as the evening proceeds, and towards closing time, many businesses find that they have run out of suitable storage area for the empty beverage containers. The storage of the empty containers requires a considerable amount of effort as well as an abundance of space until the empty containers can be hauled to a recycle facility or disposal area.

Surprisingly, a crushed container assumes only about 16% of the original container volume. Accordingly, where the containers are being accumulated in a trash receptacle, only a fraction of the number of receptacles are required for holding the crushed beverage containers as contrasted to the original container.

The containers usually are made of alluminum, and therefore, are of significant value for recycle purposes. The crushed containers are decidedly easier to handle and can easily be transported in appreciably greater numbers when processed into a flattened or crushed configuration.

It would therefore be desirable to have made available a simple apparatus which can be continuously operated and which easily crushes metal containers into a flat configuration. A mechanism which achieves this desirable goal is the subject of this invention.

SUMMARY OF THE INVENTION

Apparatus for crushing beverage containers into a flattened configuration which enables the flattened containers to be stored in a minimum volume. The apparatus comprises spaced parallel shafts which moveably support an endless belt. The belt is arranged about the two shafts in the configuration of an oval track. A curved plate member is arranged in spaced confronting relation respective to the belt member. The plate member has a straight portion which lies at an acute angle respective to a plane passing through the longitudinal axial centerline of the two spaced shafts, and accordingly, the adjacent or confronting faces of the plate member and the belt converge downwardly respective to one another, thereby forming a chamber into which empty containers are charged. As the plate member approaches the belt, a marginal portion thereof curves about one end of the track, with the intervening space left therebetween being approximately equivalent to the thickness of the crushed beverage container.

An inlet chute overlies the chamber formed between the oval track and the plate member so that empty beverage containers may be dropped therethrough and into the container receiving chamber. The endless belt moves along its length and towards the plate member carrying the containers through the progressively narrowing slot, so that the belt presses the container against the curved part of the plate, thereby crushing the container so that the crushed container exits from the end of the plate and is received in a suitable storage means.

A primary object of the present invention is the provision of apparatus for crushing beverage containers into a flattened configuration so that the resultant crushed container occupies a much smaller volume.

Another object of the present invention is the provision of apparatus by which containers can be continuously crushed into a flattened configuration by collapsing the opposed cylindrical sidewall thereof towards one another.

A further object of this invention is the provision of container crushing apparatus for flattening beverage containers which have an inlet and outlet arranged in a manner to avoid accidentally crushing the operator's hands.

Another and still further object of the present invention is the provision of container crushing apparatus comprising an endless belt which moves to describe an oval track, and having a side of the belt arranged at an acute angle respective to a plate member so that beverage containers passing between the belt and plate are crushed into a flattened configuration.

An additional object of the present invention is the provision of apparatus for crushing beverage containers into a flattened configuration, wherein the containers gravitate into the intervening space formed between an endless moving belt and a fixed plate, with the plate and belt converging towards one another to provide a converging slot therebetween, wherein the slot area progressively diminishes as the plate approaches the surface of the belt, so that as the container is forced to travel through the slot by the action of the traveling belt, the container is progressively crushed into a flattened configuration which reduces its volume considerably.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
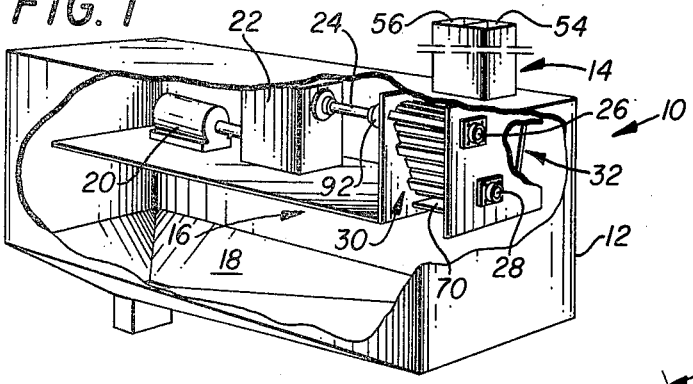
FIG. 1 is a perspective view of an apparatus for crushing beverage containers made in accordance with the present invention, with some parts thereof being removed therefrom so as to illustrate the interior details thereof.

FIG. 1, together with the other figures of the drawings, discloses apparatus 10 for crushing empty beverage containers, such as empty 12 ounce aluminum beer cans, for example. The apparatus is housed within a cabinet 12 having a container inlet 14 through which empty containers to be crushed are introduced into the crusher mechanism 16. The lower end of the housing forms a receptacle 18 which receives crushed containers exiting from the apparatus 16.

A motor 20 drives a reduction gear box 22 which rotates a shaft 24. The shaft 24 directly drives an upper shaft having an end denoted by numeral 26. A lower shaft is positioned parallel to shaft 26 and has a terminal shaft end denoted by numeral 28. A wide, metal, endless belt 30 is supported for movement by the two parallel shafts, as will be more fully discussed later on in this disclosure.

Figure 2:
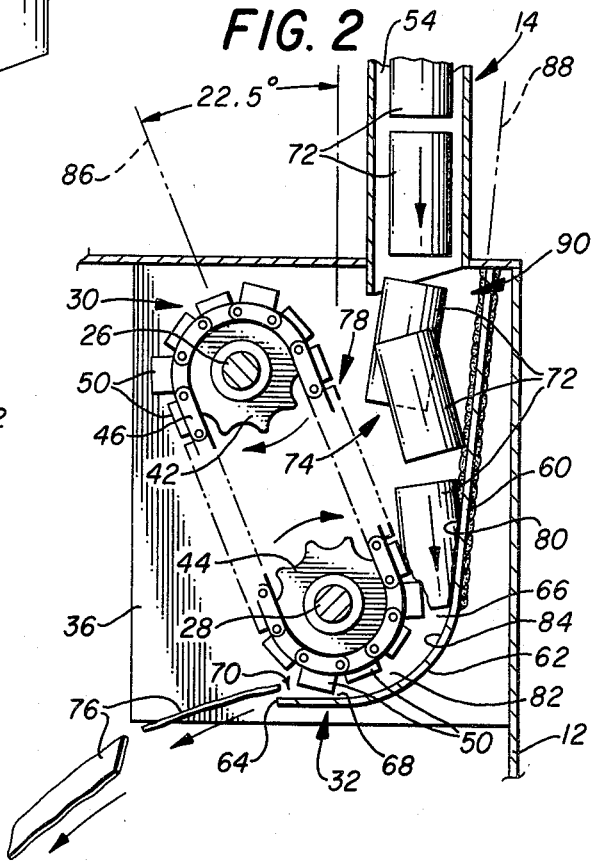
FIG. 2 is an enlarged, side elevational view of part of the apparatus disclosed in FIG. 1, with some parts being broken away therefrom so as to disclose the details of the interior thereof.
Figure 3:
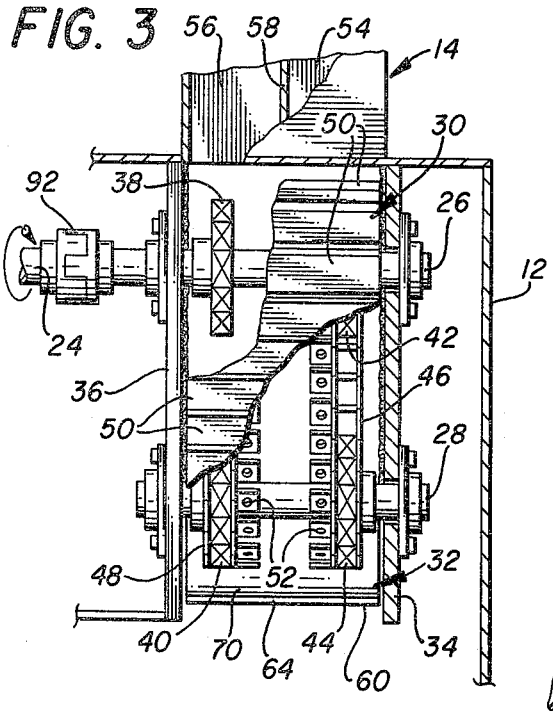
FIG. 3 is a fragmented, front elevational view of part of the apparatus disclosed in the foregoing figures, with some parts thereof being broken away therefrom so as to better illustrate the details thereof.
Figure 4:
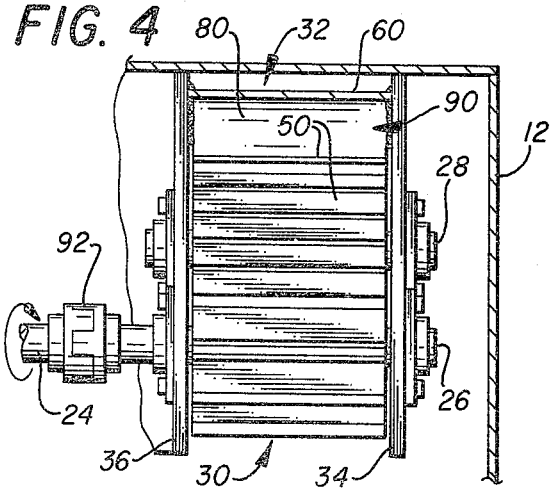
FIG. 4 is a top, plan view of part of the apparatus disclosed in the foregoing figures; and, FIG. 5 is a part diagrammatical, part schematical illustration which discloses the present invention.
Figure 5:
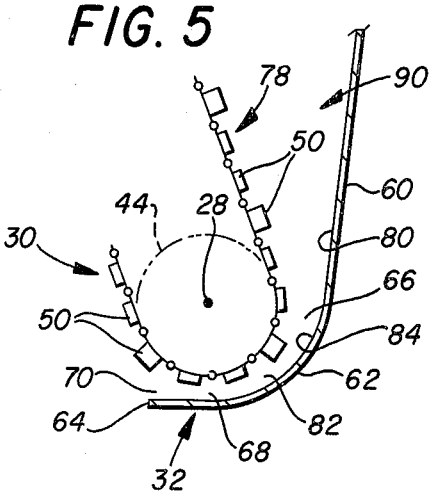

As particularly illustrated in FIGS. 2 and 3, together with other figures of the drawings, a fixed plate member 32 is attached to spaced parallel support plate members in the form of bulkheads 34 and 36. The bulkheads are rigidly affixed to the cabinet frame members and support spaced marginal lengths of the before mentioned shafts 26 and 28. The upper and lower shafts have inboard sprockets 38 and 40 affixed thereto in spaced relationship respective to a pair of outboard sprockets 42 and 44. The inboard and outboard pairs of sprockets are aligned with one another, so that spaced endless chains 46 and 48, respectively, can be mated with the pairs of sprockets 42, 44; and 38, 40; respectively, thereby effecting drive sprockets 38, 42 and idler sprockets 40, 44.

Parallel metal bars 50 are slightly spaced from one another and laterally positioned in attached relationship to each of the spaced endless chains 46 and 48, thereby providing the face or surface of the before mentioned endless belt 30 which is supported for movement on the spaced shafts 26 and 28.

The container inlet 14 is comprised of dual passageways 54 and 56 of a size to enable a beverage container, such as a beer can, to be received therewithin, with a divider 58 being positioned coextensive therewith for preventing one's hand from continuing into the inlet chamber 90. The length of the inlet is such that an ordinary person's arm is insufficient in length to enable him to reach the internal mechanism of the apparatus.

The before mentioned curved plate member 32 includes a straight marginal length indicated by numeral 60 and a curved marginal length indicated by numeral 62, and a lower terminal edge portion 64. The curvature of the plate is progressive and is increased in a direction towards the axial centerline of the lower shaft from area 66 to 68. The plate curves towards and about the lower end of the oval track described by the endless belt.

The converging belt and plate member provide a downwardly converging opening which commences at 90, then more rapidly converges at 66, and which continues to be reduced in a progressive manner until the inside surface of the plate is slightly spaced from the outer surface of the belt at 68. The arrow at numeral 70 indicates the outlet of the mechanism from which flattened containers emerge.

Hence, the belt and plate jointly cooperate together to describe an upwardly diverging chamber which has a curved slot at the bottom through which containers are forced whereupon the containers are progressively flattened as they are forced by the belt to move through the diminishing slot opening, so that the force required to flatten the container is exerted over a long length of travel, and a considerable time interval.

Numeral 72 indicates empty beverage containers which have been placed within the container inlet 14. The containers fall by gravity into the chamber 90 and assume a haphazard position indicated by numeral 74. The crushed containers are illustrated by numeral 76.

Looking again to FIG. 2, it will be noted that numerals 78 and 80 illustrate confronting faces of the endless belt and fixed plate which describe acute angles 86, 88 respective to one another, and, together with the spaced bulkheads, form the chamber 90. The flat surface of the belt and the flat surface of the fixed plate describe planes which are parallel to one another in a horizontal plane and intersect one another in a vertical plane. The before mentioned converging opening 66 continues to diminish at 82 and reaches its minimum at 68, where the containers exit at 70. The curved portion of the plate member commences at 84 and continues toward the curved portion 82 of the track at 68.

Either of the spaced, parallel shafts 26 and 28 can be driven. It is preferred that one of the shafts idle respective to the other. The sprockets may be of different diameters if preferred. In the preferred embodiment, the shafts 26 and 28 are one inch in diameter, and the sprockets are each provided with twelve teeth placed in the usual manner thereon. The sprockets mesh with a commercially available roller chain having bent attachments by which the transverse bars are attached. The plate 60 is 3/16 inch in thickness, and the space at 68 is reduced to approximately 1/16 inch.

It is preferred to leave the trailing marginal end of the plate unattached to the spaced bulkheads so that should two containers overlap one another, the marginal trailing end of the plate can deform sufficiently to prevent injury to the apparatus.

Eight containers can be accumulated in the inlet. The apparatus crushes 10–12 cans a minute, using a ½ horsepower motor driving a 6 inch belt at a rotational belt speed of 2.25 rpm. The opening provided at the top of the belt and plate is $6\times4\frac{1}{2}$ inches, which decreases to a discharge slot opening of $6\times1/16$ inches.

The belt bars are $6\times1\times3/16$ inches and $6\times1\times\frac{1}{2}$ inches, with each third bar being the thickest. This constructional arrangement provides the endless belt with alternate pads of uneven elevation which act as a lug to help pull the beverage containers through the progressively narrowing slot, thereby causing the opposed cylindrical container walls to be forced towards one another.

I claim:

1. Apparatus for crushing beverage containers comprising upper and lower shafts disposed in spaced parallel relationship;

an endless belt, means by which said endless belt is supported by said upper and lower shafts, drive means by which said endless belt is caused to move along its length to describe an oval track;

a curved plate member arranged in spaced relationship respective to said belt, said plate member and the confronting face of said belt being arranged in planes which lie at an acute angle respective to one another and which converge towards one another with the plate member curving about a lower end of the oval track to provide a slot through which containers are forced;

so that a metal beverage container can be dropped into the converging space, whereupon the belt forces the container through the slot, which crushes the opposed sidewalls of the container together.

2. The apparatus of claim 1 wherein said shafts have spaced pairs of sprockets mounted thereon, a spaced endless chain meshed with each pair of sprockets, and a plurality of bars attached to the chain to provide said belt.

3. The apparatus of claim 2 wherein said upper and lower shafts are arranged such that a plane passing therethrough lies at an acute angle respective to the vertical, and a marginal length of said plate member is arranged substantially vertical, thereby forming a chamber within which empty containers are received;

said chamber progressively reduces in width in a downward direction with the lower marginal length of the plate member curving about and towards the belt such that the opening between the belt and plate member progressively diminishes to a size which causes the opposed sidewalls of the container to be forced into engagement with one another as the container passes therethrough.

4. The apparatus of claim 3 and further including an inlet chute which is positioned above said chamber, said chute having a divider wall therein which is longitudinally disposed and divides the chute into two passageways for receiving containers therein, so that two containers can be simultaneously placed within the chute whereupon the containers gravitate down to the chamber.

5. The apparatus of claim 1 wherein said upper and lower shafts are arranged such that a plane passing therethrough lies at an acute angle respective to the vertical, and a marginal length of said plate member is arranged substantially vertical, thereby forming a chamber within which empty containers are received;

said chamber progressively reduces in width in a downward direction with the lower marginal length of the plate member curving about and towards the belt such that the opening between the belt and plate member progressively diminishes to a size which causes the opposed sidewalls of the container to be forced into engagement with one another as the container passes therethrough.

6. Apparatus for crushing beverage containers comprising: spaced parallel bulkheads, first and second shafts spaced from one another, means mounting opposed marginal lengths of said first and second shafts within said bulkheads in parallel relationship respective to one another;

an endless belt, means supporting said belt about each said shaft in a manner to enable the belt to describe an oval track as the belt moves along its length;

a plate member arranged parallel to each said shaft, and having a marginal length which is disposed at an acute angle to a plane passing through both shafts, said plate member having a curved marginal end which curves inwardly towards the lower curved end of the track and which generally curves about the lower curved end of the oval track;

an inlet overhanging the area formed between the plate member and track through which metal containers can travel and gravitate into the space between the belt and plate member so that the belt engages and forces the container against the plate member;

whereby the belt and plate member have adjacent surfaces which downwardly converge with the belt describing a circle about the lower shaft and with the plate member curving in spaced relationship therewith, and with the intervening space between the belt surface and adjacent surface of the plate member being of a dimension which is smaller than the diameter of a container, so that when the container is forced therethrough, it is crushed flat into a thickness about equal to the space between the belt and plate member.

7. The apparatus of claim 6 wherein said shafts have spaced pairs of sprockets mounted thereon, a spaced endless chain meshed with each pair of sprockets, and a plurality of bars attached to the chain to provide said belt.

8. The apparatus of claim 7 wherein said upper and lower shafts are arranged such that a plane passing therethrough lies at an acute angle respective to the vertical, and a marginal length of said plate member is arranged substantially vertical, thereby forming a chamber within which empty containers are received;

said chamber progressively reduces in width in a downward direction with the lower marginal length of the plate member curving about and towards the belt such that the opening between the belt and plate member progressively diminishes to a size which causes the opposed sidewalls of the container to be forced into engagement with one another as the container passes therethrough.

9. The apparatus of claim 8 and further including an inlet chute which is positioned above said chamber, said chute having a divider wall therein which is longitudinally disposed and divides the chute into two passageways for receiving containers therein, so that two containers can be simultaneously placed within the chute whereupon the containers gravitate down to the chamber.

10. The apparatus of claim 6 wherein said upper and lower shafts are arranged such that a plane passing therethrough lies at an acute angle respective to the vertical, and a marginal length of said plate member is arranged substantially vertical, thereby forming a chamber within which empty containers are received;

said chamber progressively reduces in width in a downward direction with the lower marginal length of the plate member curving about and towards the belt such that the opening between the belt and plate member progressively diminishes to a size which causes the opposed sidewalls of the container to be forced into engagement with one another as the container passes therethrough.

* * * * *